United States Patent [19]

Schlick

[11] 4,302,912

[45] Dec. 1, 1981

[54] TROUGH BELT CLEANING APPARATUS ADAPTED FOR RADIAL FEEDING

[75] Inventor: Horst-Dieter Schlick, Metelen, Fed. Rep. of Germany

[73] Assignee: Schlick-roto-jet Maschinenbau GmbH, Metelen, Fed. Rep. of Germany

[21] Appl. No.: 129,998

[22] Filed: Mar. 13, 1980

[30] Foreign Application Priority Data

Mar. 19, 1979 [DE] Fed. Rep. of Germany ..... 2910754

[51] Int. Cl.[3] ..... B24C 1/00; B24C 3/18

[52] U.S. Cl. ..... 51/418; 51/423; 51/319; 198/343

[58] Field of Search ..... 51/313, 319–321, 51/418, 163.1, 422, 423; 134/71, 72, 75, 128, 131; 198/343, 345

[56] References Cited

U.S. PATENT DOCUMENTS

| | | | |
|---|---|---|---|
| 1,490,515 | 4/1924 | Kulczycke | 134/75 |
| 2,538,242 | 1/1951 | Hannon | 51/163.1 X |
| 2,554,701 | 5/1951 | Hackett | 51/163.1 X |
| 2,724,930 | 11/1955 | Oddie | 51/423 |

FOREIGN PATENT DOCUMENTS

| | | | |
|---|---|---|---|
| 2613669 | 10/1977 | Fed. Rep. of Germany | 51/418 |
| 1168448 | 12/1958 | France | 51/163.1 |
| 778848 | 7/1957 | United Kingdom | 51/418 |

*Primary Examiner*—Gary L. Smith

*Attorney, Agent, or Firm*—Fitch, Even, Tabin, Flannery & Welsh

[57] ABSTRACT

A trough belt cleaning apparatus adapted to be continuously fed with articles in radial direction, particularly a blasting system, wherein the articles to be cleaned are placed onto a belt and discharged from the latter when the cleaning operation has been performed wherein the belt defines, as seen in the direction of belt travel, first a receiving or collecting trough and a subsequent downstream processing trough with the processing trough being defined or bounded on the upstream and downstream sides, as seen in belt travelling direction by guide pulleys acting to deflect the belt during the processing operation, and wherein the pulleys are adapted to be raised and lowered while the belt is travelling.

9 Claims, 6 Drawing Figures

TROUGH BELT CLEANING APPARATUS ADAPTED FOR RADIAL FEEDING

The present invention relates to a trough cleaning apparatus adapted to be continuously fed with articles in radial direction, particularly a blasting system, wherein the articles to be cleaned are placed onto a belt and discharged from the latter when the cleaning operation has been performed.

Conventional trough belt blasting systems can be fed radially, but are discharged in any case in discontinuous manner by reversing the direction of travel of the belt. Thus, with continuous feeding, different periods of treatment result for the workpieces placed into the apparatus at different times. Therefore, the batchwise feeding it most frequently used in practice, because continuous feeding necessarily results in insufficient cleaning and other treatment of the workpieces fed into the apparatus last.

In order to eliminate these drawbacks, other blasting systems are known wherein treatment is effected in acially fed drums (cylinders). Discharge takes place on the opposite side of the drum. However, it is of disadvantage in such systems that the drum must be filled to a certain degree to allow the workpieces to pass therethrough, such that an angle of slope is provided. Thus, systems of this type can operate satisfactorily only with given quantities of the objects to be cleaned per unit of time, and it is not improbable even in such case that some workpieces pass trough the drum in too short a time. Accomodation to varied conditions of operation is not possible, or to limited extent only.

Furthermore, blasting systems are known which operate as belt-type systems (Swiss Pat. No. 596,955) in order to avoid the abovementioned drawbacks, wherein the workpieces are placed onto belts without troughs or trays. In view of the fact that the lower sides of the workpieces have to be blasted and cleaned, too, the belts are subsequently inversed. The overall design of such system is extremely expensive and subject to trouble, and it has been found that the cleaning efficiency is not at all comparable to that which can be obtained by trough belt systems.

Accordingly, it is the object of the present invention to provide a blasting-medium cleaning system or apparatus which does not suffer from the abovementioned deficiencies and which, in particular, permits the workpieces to be subjected to cleaning during a defined, variable period of time, while continuous feeding the workpieces.

Further, this system or apparatus should be of uncomplicated construction and safe in operation, while combining the advantages of conventional through belt cleaning systems with the advantages of continuous feeding.

In the trough belt cleaning apparatus as outlined above, this object is solved according to the invention in that said belt defines, as seen in the direction of belt travel, first a receiving or collecting trough and a subsequent, downstream processing trough, with said processing trough being defined or bounded on the upstream and downstream sides, as seen in belt travelling direction, by guide pulleys acting to deflect said belt during the processing operation, and that said pulleys are adapted to be raised and lowered while said belt is travelling.

Advantageously, the apparatus according to the invention is operated such that the following cycles of operation take place in continuous succession:

(a) Collecting the supplied workpieces within the collecting trough, while simultaneously blast-finishing workpieces in the processing trough;

(b) discharging the cleaned workpieces; and (c) transferring the collected workpieces from the collecting trough into the processing trough.

In order to provide for positive guidance of the belt even with varied positioning of the (guide) pulleys definiting the trough or tray, advantageously there is provided at least one further tensioning pulley, i.e. drum, cylinder, roller or the like, acting upon the returning belt portion and being adapted to be raised and lowered, which tensioning pulley may be weight-loaded and preferably positioned between the returning (guide) pulley for the belt and additional (guide) pulleys contacting the belt from below. In order to form the receptacle or collecting trough, advantageously a holddown guide means or pulley is positioned upstream of the first raisable and lowerable (guide) pulley, as seen in the direction of belt travel, and an identical holddown pulley may be disposed also at the rear of the second raisable and lowerable (guide) pulley, as seen in belt travelling direction.

Below, an embodiment of the invention is described in greater detail by referring to the accompanying drawings, wherein.

Figure 1:
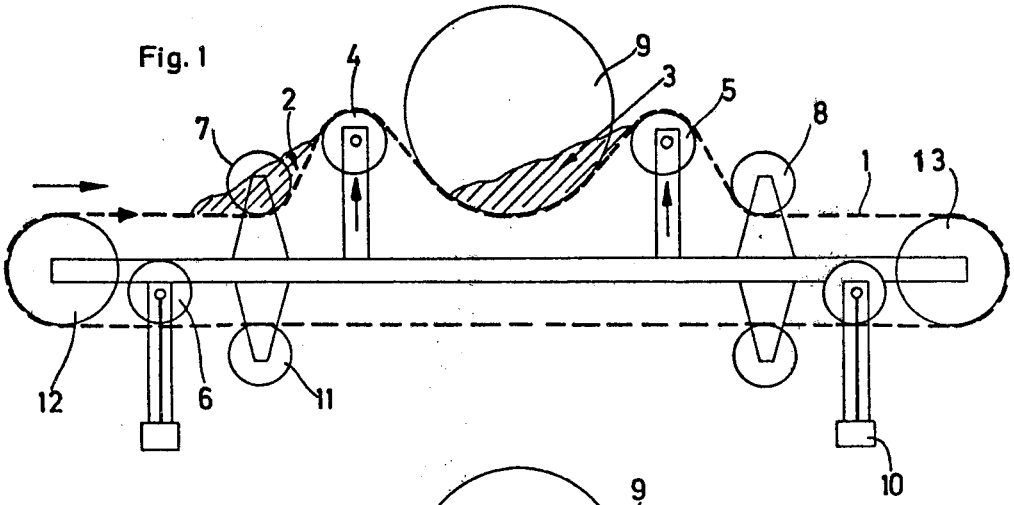
FIG. 1 is a schematical view of the blasting system according to the invention during a collecting or receiving and cleaning cycle.

As shown in the figures, a blasting system according to the invention comprises a rotating endless conveyor belt composed of perforated rubber, assembled links or the like which are interconnected by rods extending transversely through the belt. When linked belts of this type are used, the edges of the belt are formed as chains which are engaged, in conventional manner, with guide pulleys or sprockets (guide elements) for tensioning, guiding and driving purposes.

As seen in the direction of belt travel, a holddown (guide) pulley 7 is positioned above the belt downstream of the front returning or rerouting roller or pulley 12, which holddown pulley is mounted stationarily and defines a receiving or collecting trough 2 for the continuous radial feeding of workpieces. Thus, the system according to the invention need not be fed in batchwise manner, such that an auxiliary lifting mechanism, including controls therefor, may be omitted.

Rewardly or downstream of pulley 7 a raisable and lowerable (guide) pulley 4 is provided, which in the raised position thereof defines the processing trough in combination with disc pulleys 9 and subsequently disposed (guide) pulleys 5 which are likewise adapted to be raised and lowered.

As seen in the direction of belt travel, downstream of the raisable and lowerable pulley 5 there is provided another stationary (guide) pulley 8 from which the belt passes towards the rear returning roller or pulley 13.

At the returning portion of the belt, downstream of roller(s) or Pulley(s) 13 there is positioned a pulley 6 loaded by a weight 10 to tension the belt, and downstream of which another, again stationary, pulley 11 is provided. Downstream of pulley 11, another pair of rollers 6 and 11 may be present a short distance upstream of the front returning roller or pulley 12; in such case, however, pulley 11 is arranged upstream of the weight-loaded, raisable and lowerable pulley 6.

The apparatus of the invention may be simplified by omitting some of the guide pulleys. In such case, the belt may be tensioned by the weight of the unsupported, returning belt portion per se, and the belt may travel directly from pulleys 5 towards the rear returning roller or pulley. However, pulleys 7, 4, 5 and 9 are absolutely necessary, because these pulleys define a pair of troughs or trays arranged one behind the other and being adapted to be fed radially, which troughs may be discharged in radial direction without the necessity of varying the direction of belt travel and thereby interrupting the continuous material supply.

Figure 2:
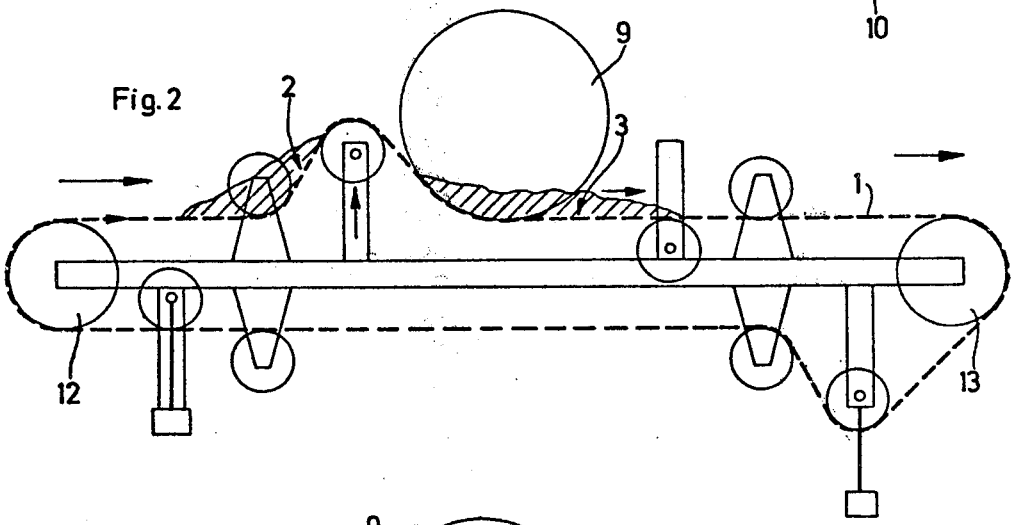
FIG. 2 shows the system during the discharging cycle.

The apparatus according to the invention operates as follows:

As shown in FIG. 1, workpieces are supplied continuously to be received in through 2, while the processing or treatment of workpieces takes place simultaneously in trough 3 during a predetermined, selectively controllable period. Subsequently, pulley 5 is lowered, and the cleaned workpieces, as shown in FIG. 2, are discharged from the processing trough 3. These workpieces may be further processed or further transported in batch-wise manner; on the other hand, the workpieces may drop into a self-discharging reservoir from which these workpieces may be removed continuously and separately, for instance, by means of a helical chute, or from which they exit automatically under gravity action.

Figure 3:
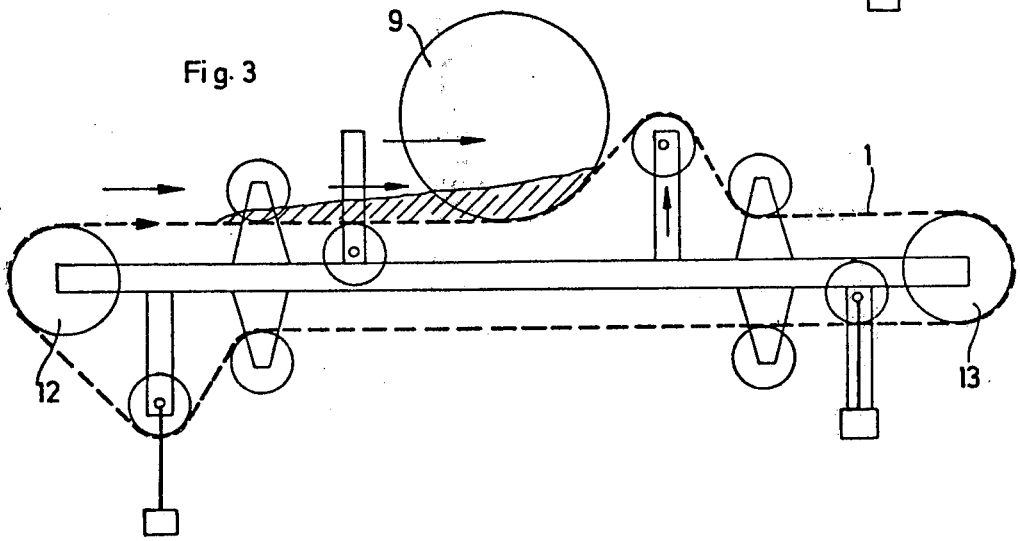
FIG. 3 shows the system during the transfer cycle in which the workpieces are transferred from the collecting through to the processing trough.

As shown in FIG. 3, pulley 5 is then raised again, and pulley 4 is lowered, such that the workpieces are transferred from trough 2 into trough 3. Thereupon, pulley 4 is raised again, and the collecting and processing cycle is repeated.

Figure 5:
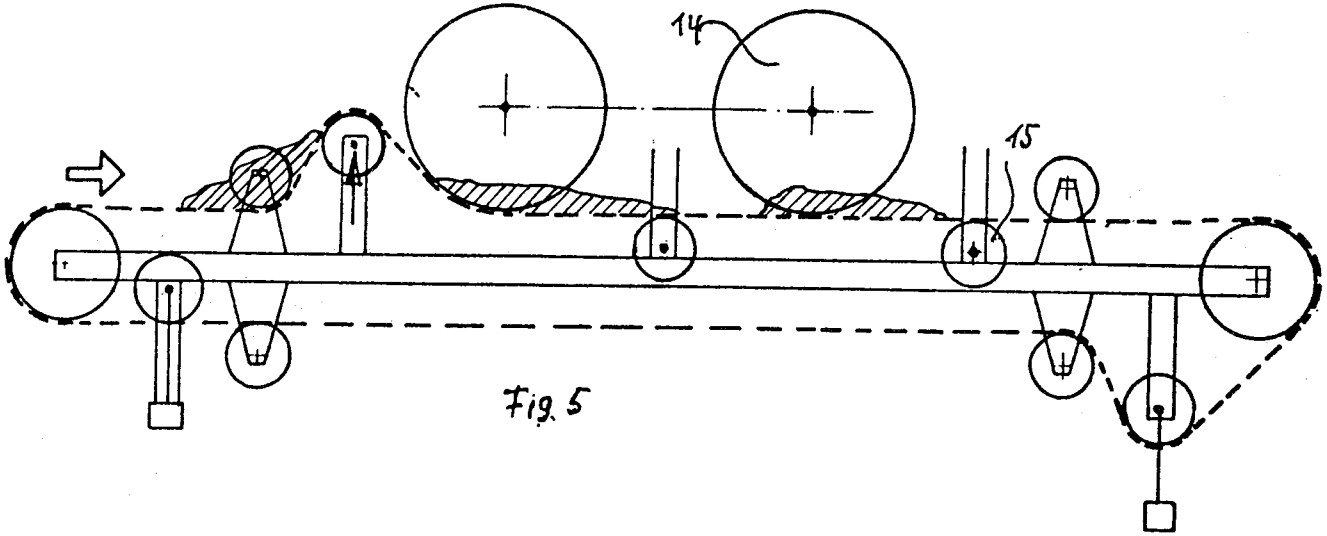
FIG. 5 illustrates the system according to FIG. 4 during the discharging cycle.
Figure 4:
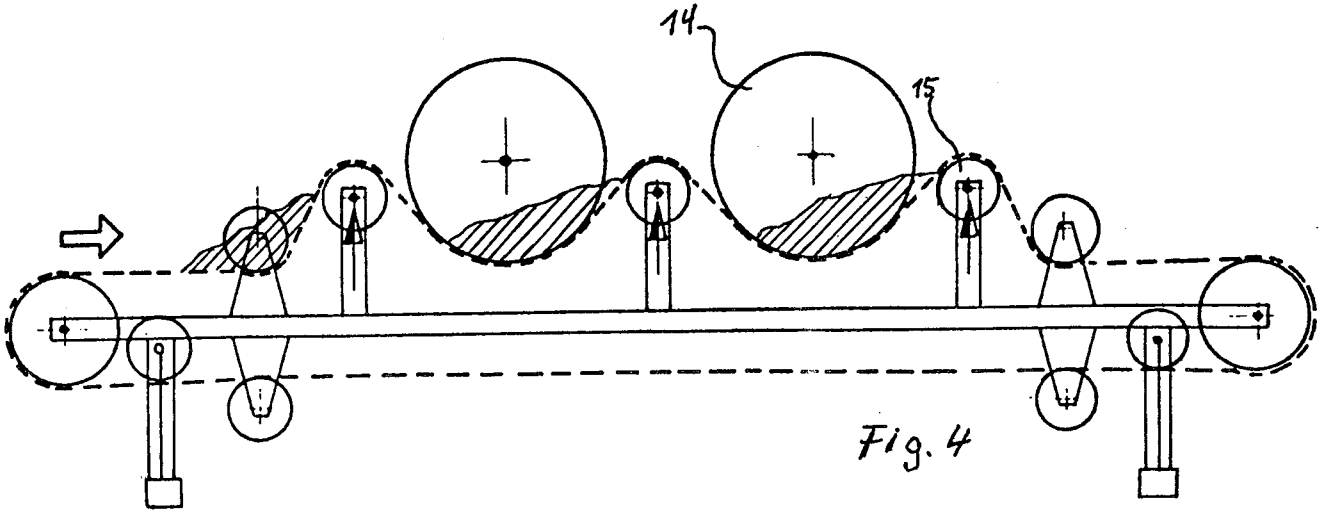
FIG. 4 is a schematical view of the blasting system according to the invention during a collecting and cleaning cycle, with the system including a processing trough and an afterprocessing trough or tray.
Figure 6:
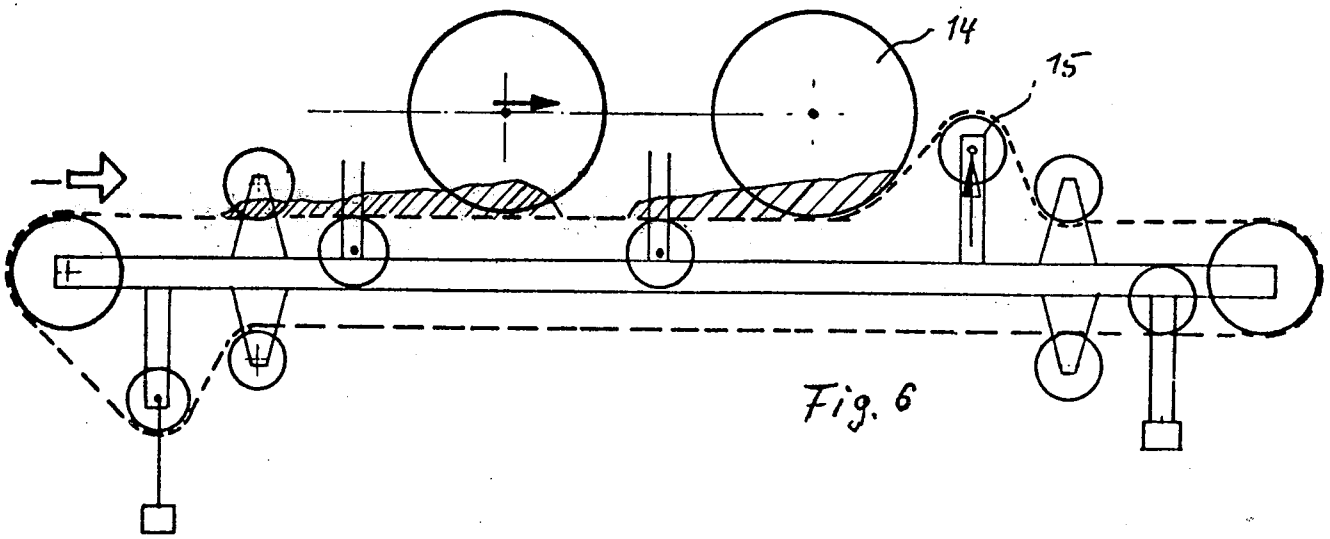
FIG. 6 shows the system according to FIG. 4 during the cycle of transferring the workpieces from the collecting trough to the processing trough and from the latter to the afterprocessing trough.

According to FIGS. 4 to 6, the blasting system of the invention may have added thereto an aftertreating or afterprocessing trough or tray, by providing downstream of the processing trough, another trough defined by lateral disc pulleys 14 and a raisable and lowerable guide pulley 15. In this manner, the already blasted material may be cleaned once again such that e.g. the blasting medium may be positively removed even from workpieces of complex configuration and including cavities.

While the processing trough 3 proper is being fed, the already blasted workpieces are transferred into the aftertreating trough, and an operating cycle may then be initiated for both processing troughs upon raising the pulley 5 (FIG. 4). As shown in FIG. 5, both troughs are discharged at the same time, and the feeding of workpieces takes place simultaneously, too, as shown in FIG. 3. Operation of the collecting trough 2 and the remainder of the components of the apparatus according to the invention are substantially not varied.

What we claim is:

1. A trough belt cleaning apparatus adapted to be continuously fed with articles in radial direction, particularly a blasting system, wherein the articles to be cleaned are placed onto a belt and discharged from the latter when the cleaning operation has been performed, characterized in that said belt (1) defines, as seen in the direction of belt travel, first a receiving or collecting trough (2) and a subsequent, downstream processing trough (3), with said processing trough (3) being defined or bounded on the upstream and downstream sides, as seen in belt travelling direction, by guide pulleys (4, 5) acting to deflect said belt (1) during the processing operation, and that said pulleys (4, 5) are adapted to be raised and lowered while said belt is travelling.

2. The apparatus according to claim 1, characterized in that at least one further tensioning pulley (6) adapted to be raised and lowered and acting upon the returning belt (portion) from above is provided.

3. The apparatus according to claim 1 or 2, characterized in that a holddown pulley (7) is provided in front of the upstream raisable and lowerable (guide) pulley (4).

4. The apparatus according to claims 1 to 3, characterized in that a further holddown pulley (8) is provided downstream of said rear or downstream raisable and lowerable pulley (5).

5. The apparatus according to claim 2, characterized in that said tensioning pulley (6) or said tensioning pulleys (6) is or are weight-loaded, respectively.

6. The apparatus according to claims 1 to 5, characterized in that said tensioning pulley(s) (6) is (are) positioned between the returning pulleys or rollers (12, 13) and further pulleys (11) acting upon said returning belt portion from below.

7. The apparatus according to claims 1 to 6, characterized in that a further aftertreating trough is defined downstream of said processing trough (3), which trough in its operative position is defined or bounded on the downstream side by a further raisable and lowerable pulley (15).

8. A method of cleaning articles with a trough belt cleaning apparatus adapted to receive continuously fed articles in radial direction, comprising the steps of:

placing the articles to be cleaned onto a belt, said belt defining as seen in the direction of belt travel first a receiving or collecting trough collecting the supplied workpieces within the collecting trough, while simultaneously blast-finishing workpieces in a subsequent downstream processing trough; said processing trough being defined or bounded on the upstream and downstream sides, as seen in belt travelling direction, by guide pulleys acting to deflect said belt during the processing operation, transferring the collected workpieces from the collecting trough into the processing trough, said pulleys (4, 5) are adapted to be raised and lowered while said belt is travelling, discharging the cleaned workpieces.

9. A method according to claim 8, characterized by the following cycles of operation:

(a) collecting the supplied workpieces within the collecting trough, while simultaneously blast-finishing workpieces in the processing trough and in an aftertreating trough;

(b) discharging the cleaned workpieces from the processing trough into the aftertreating trough, as well as from the aftertreating trough; and (c) transferring the collected workpieces from the collecting trough into the processing trough, and from the processing trough into the aftertreating trough.

* * * * *